US009514729B2

(12) United States Patent
Yoshihama

(10) Patent No.: US 9,514,729 B2
(45) Date of Patent: Dec. 6, 2016

(54) MUSICAL INSTRUMENT, METHOD AND RECORDING MEDIUM CAPABLE OF MODIFYING VIRTUAL INSTRUMENT LAYOUT INFORMATION

(71) Applicant: CASIO COMPUTER CO., LTD., Shibuya-ku, Tokyo (JP)

(72) Inventor: Yuki Yoshihama, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 171 days.

(21) Appl. No.: 13/768,889

(22) Filed: Feb. 15, 2013

(65) Prior Publication Data

US 2013/0239781 A1 Sep. 19, 2013

(30) Foreign Application Priority Data

Mar. 16, 2012 (JP) ..... 2012-061216

(51) Int. Cl.
*G10H 3/00* (2006.01)
*G10H 7/00* (2006.01)
*G10H 1/00* (2006.01)

(52) U.S. Cl.
CPC ..... *G10H 7/00* (2013.01); *G10H 1/0008* (2013.01); *G10H 2220/455* (2013.01); *G10H 2230/281* (2013.01)

(58) Field of Classification Search
USPC ..... 84/737
See application file for complete search history.

(56) References Cited

U.S. PATENT DOCUMENTS

| | | | |
|---|---|---|---|
| 5,177,311 | A | 1/1993 | Suzuki et al. |
| 5,290,964 | A | 3/1994 | Nakada et al. |
| 8,586,853 | B2 | 11/2013 | Sakazaki |
| 2006/0144212 | A1 | 7/2006 | Hofmeister et al. |
| 2007/0265104 | A1 | 11/2007 | Haga et al. |

(Continued)

FOREIGN PATENT DOCUMENTS

| | | | |
|---|---|---|---|
| JP | 2004-252149 | A | 9/2004 |
| JP | 3599115 | B2 | 12/2004 |
| JP | 2011-128427 | A | 6/2011 |

OTHER PUBLICATIONS

U.S. Appl. No. 13/768,924; First Named Inventor: Yuki Yoshihama; Title: "Musical Instrument, Method and Recording Medium", filed Feb. 15, 2013.

*Primary Examiner* — Christopher Uhlir
(74) *Attorney, Agent, or Firm* — Holtz, Holtz & Volek PC

(57) ABSTRACT

A musical instrument includes memory that stores layout information defining regions arranged on a predetermined virtual plane, and a position sensor that detects the position coordinates on the virtual plane of a music playing member that can be held by a player. First, it is determined whether the position coordinates of the music playing member belong to a region arranged on the virtual plane based on the layout information, at a timing at which a specific music playing operations is made. Herein, in a case of having determined as belonging to a region, the generation of sound of a musical note corresponding to this region is instructed, in a case of having determined as not belonging to a region, the layout information stored in the memory is modified in order to modify this region so as to include the position coordinates of the music playing member.

12 Claims, 8 Drawing Sheets

(56) References Cited

U.S. PATENT DOCUMENTS

| | | | | |
|---|---|---|---|---|
| 2007/0270217 | A1 | 11/2007 | Rabin | |
| 2008/0311970 | A1 | 12/2008 | Kay et al. | |
| 2012/0006181 | A1 | 1/2012 | Harada et al. | |
| 2012/0137858 | A1 | 6/2012 | Sakazaki | |
| 2012/0152087 | A1 | 6/2012 | Sakazaki | |
| 2012/0216667 | A1 | 8/2012 | Sakazaki | |
| 2013/0047823 | A1 | 2/2013 | Tabata | |
| 2013/0152768 | A1* | 6/2013 | Rapp | 84/634 |
| 2013/0239780 | A1 | 9/2013 | Tabata | |
| 2013/0239782 | A1 | 9/2013 | Yoshihama | |
| 2013/0239783 | A1 | 9/2013 | Tabata et al. | |
| 2013/0239784 | A1 | 9/2013 | Tabata | |
| 2013/0239785 | A1 | 9/2013 | Tabata | |
| 2013/0255476 | A1 | 10/2013 | Sakurai et al. | |
| 2013/0262021 | A1 | 10/2013 | Sakurai et al. | |
| 2013/0262024 | A1 | 10/2013 | Sakurai et al. | |

* cited by examiner

MUSICAL INSTRUMENT, METHOD AND RECORDING MEDIUM CAPABLE OF MODIFYING VIRTUAL INSTRUMENT LAYOUT INFORMATION

This application is based on and claims the benefit of priority from Japanese Patent Application No. 2012-61216, filed on 16 Mar. 2012, the content of which is incorporated herein by reference.

BACKGROUND OF THE INVENTION

Field of the Invention

The present invention relates to a musical instrument, method and recording medium.

Related Art

Conventionally, musical instruments have been proposed that generate electronic sound in response to music playing movements, when music playing movements of a player are detected. For example, a musical instrument (air drum) has been known that generates percussion instrument sounds with only a stick-shaped member. With this musical instrument, when a stick-shaped component equipped with sensors is held by hand and a music playing movement is made such as waving as if striking a drum, the sensor detects this music playing movement, and a percussion instrument sound is generated.

According to such a musical instrument, musical notes of this instrument can be generated without requiring a real instrument; therefore, it enables a player to enjoy music playing without being subjected to limitations in the music playing location or music playing space.

As such a musical instrument, an instrument game device is proposed in Japanese Patent No. 3599115, for example, that is configured so as to capture an image of a music playing movement of a player using a stick-shaped member, while displaying a composite image combining a captured image of the music playing movement and a virtual image showing an instrument set on a monitor, and generates a predetermined musical note depending on position information of the stick-shaped member and the virtual instrument set.

However, in a case of applying the instrument game device described in Japanese Patent No. 3599115 as is, the layout information such as the arrangement of a virtual instrument set has been established in advance; therefore, in a case of the player having made a drum striking mistake, it has not been possible to modify the layout information in response to drum strike mistakes.

SUMMARY OF THE INVENTION

The present invention has been made taking account of such a situation, and an object thereof is to provide a musical instrument, method and recording medium that enable, in a case of the player having made drum strike mistakes, the layout information for the arrangement of a virtual instrument or the like to be modified in accordance with information about the mistakes.

In order to achieve the above-mentioned object, a musical instrument according to an aspect of the present invention includes: a position sensor that detects position coordinates on a virtual plane of a music playing member that can be held by a player; a determination unit that determines, based on layout information defining a region arranged on a predetermined virtual plane, whether position coordinates of the music playing member belong to a region arranged on the virtual plane, at a timing at which a specific music playing operation is made by way of the music playing member; a sound generation instruction unit that, in a case of the determination unit having determined as belonging to the region, instructs sound generation of a musical note corresponding to the region; and a modification unit that, in a case of the determination unit having determined as not belonging to the region, modifies the layout information in order to modify the region so as to include the position coordinates of the music playing member.

In addition, according to a music playing method of an aspect of the present invention, in a method for a musical instrument having a position sensor that detects position coordinates of a music playing member that can be held by a player on a virtual plane, the method includes the steps of: determining whether, at a timing at which a specific music playing operation is made by way of a music playing member, the position coordinates of the music playing member belong to a region arranged on the virtual plane based on layout information defining regions arranged on a predetermined virtual plane; instructing, in a case of determining as belonging to the region, generation of sound of a musical note corresponding to the region; and modifying, in a case of determined as not belonging to the region, the layout information in order to modify the region so as to include the position coordinates of the music playing member.

Furthermore, according to a recording medium of an aspect of the present invention, in a computer readable recording medium used in a musical instrument having a position sensor that detects position coordinates of a music playing member that can be held by a player on a virtual plane, the recording medium is encoded with a program that enables the computer to execute the steps of: determining whether, at a timing at which a specific music playing operation is made by way of a music playing member, the position coordinates of the music playing member belong to a region arranged on the virtual plane based on layout information defining regions arranged on a predetermined virtual plane; instructing, in a case of determining in the step of determining as belonging to the region, generation of sound of a musical note corresponding to the region; and modifying, in a case of determined in the step of determining as not belonging to the region, the layout information in order to modify the region so as to include the position coordinates of the music playing member.

DETAILED DESCRIPTION OF THE INVENTION

Hereinafter, embodiments of the present invention will be explained while referencing the drawings.

(Overview of Musical Instrument 1)

First, an overview of a musical instrument 1 as an embodiment of the present invention will be explained while referencing FIGS. 1A and 1B.

Figure 1A:
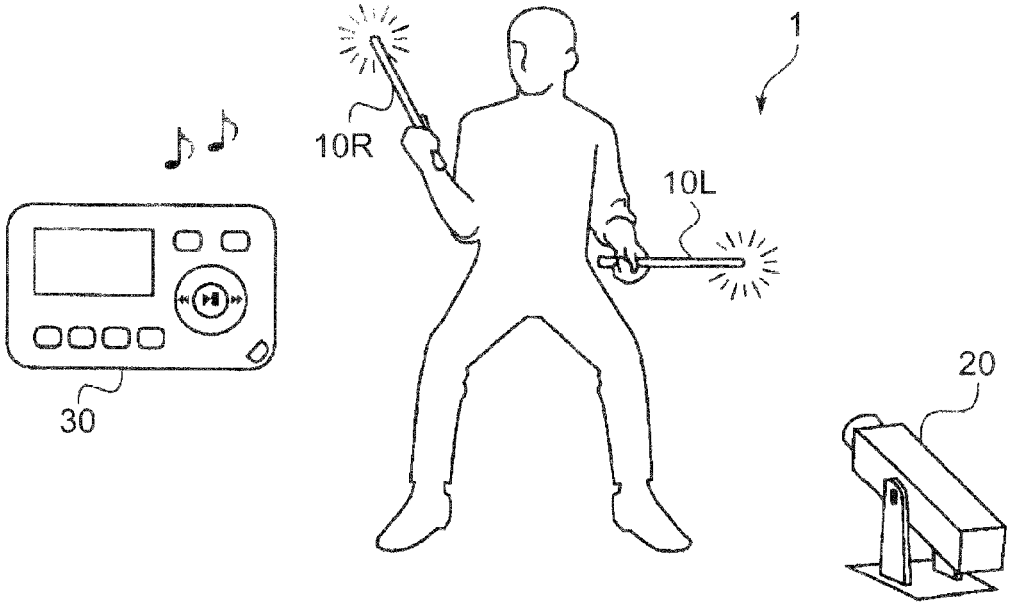
FIGS. 1A and 1B are illustrations showing an outline of an embodiment of a musical instrument according to the present invention.
Figure 1B:
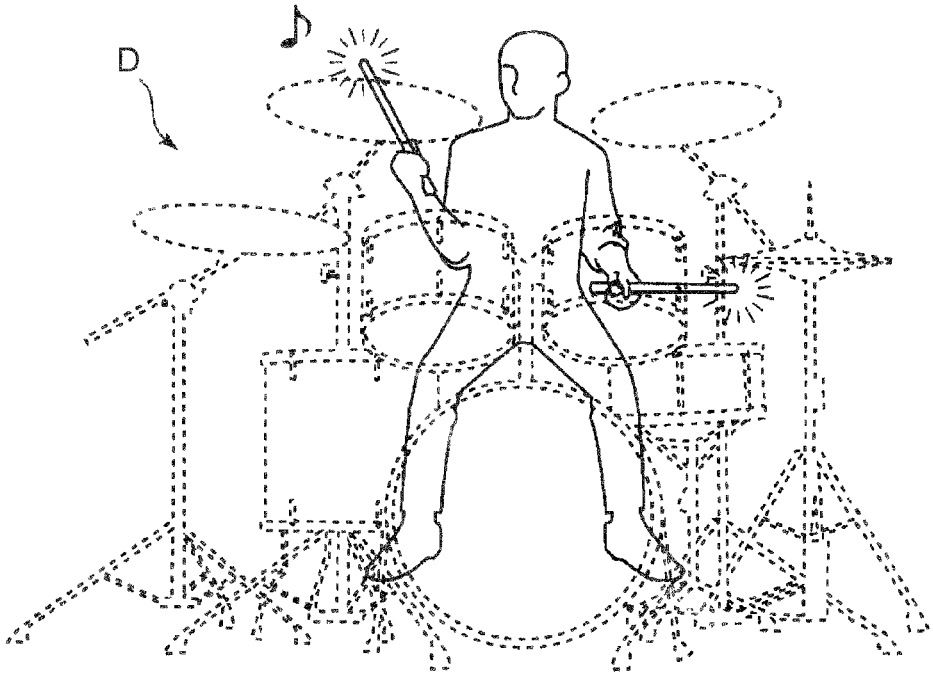

As shown in FIG. 1A, the musical instrument 1 of the present embodiment is configured to include sticks 10R, 10L, a camera unit 20, and a center unit 30. Although the musical instrument 1 of the present embodiment is configured to include the two sticks 10R, 10L in order to realize a virtual drum playing using two sticks, the number of sticks is not limited thereto, and may be one, or may be three or more. It should be noted that, in cases in which it is unnecessary to distinguish between the sticks 10L and 10R, they both will be generalized and referred to as "sticks 10" hereinafter.

The sticks 10 are members of stick shape extending in a longitudinal direction. As a music playing movement, a player makes up swing and down swing movements about the wrist, etc. holding one end (base side) of the stick 10 in the hand. Various sensors such as an acceleration sensor and angular velocity sensor are provided in the other end (leading end side) of the stick 10 in order to detect such a music playing movement of the player. Based on the music playing movement detected by these various sensors, the stick 10 sends a Note-on-Event to the center unit 30.

In addition, a marker 15 (refer to FIG. 2) described later is provided to the leading end side of the stick 10, and the camera unit 20 is configured to be able to distinguish the leading end of the stick 10 during image capturing.

The camera unit 20 is configured as an optical imaging device, and captures an image of a space including the player holding the sticks 10 and carrying out music playing movements as a subject (hereinafter referred to as "image capturing space") at a predetermined frame rate, and outputs as data of a dynamic image. The camera unit 20 specifies position coordinates within image capturing space of the marker 15 while emitting light, and sends data indicating these position coordinates (hereinafter referred to as "position coordinate data") to the center unit 30.

Upon receiving a Note-on-Event from the stick 10, the center unit 30 generates a predetermined musical note according to the position coordinate data of the marker 15 during reception. More specifically, the center unit 30 stores position coordinate data of a virtual drum set D shown in FIG. 1B, to be associated with the image capturing space of the camera unit 20, and based on the position coordinate data of this virtual drum set D and the position coordinate data of the marker 15 during Note-on-Event reception, an instrument virtually struck by the stick 10 is specified, and a musical note corresponding to the instrument is generated.

Next, the configuration of such a musical instrument 1 of the present embodiment will be specifically explained.

(Configuration of Musical Instrument 1)

First, the configurations of each constituent element of the musical instrument 1 of the present embodiment, i.e. the sticks 10, camera unit 20 and center unit 30, will be explained while referencing FIGS. 2 to 5.

(Configuration of Sticks 10)

Figure 2:
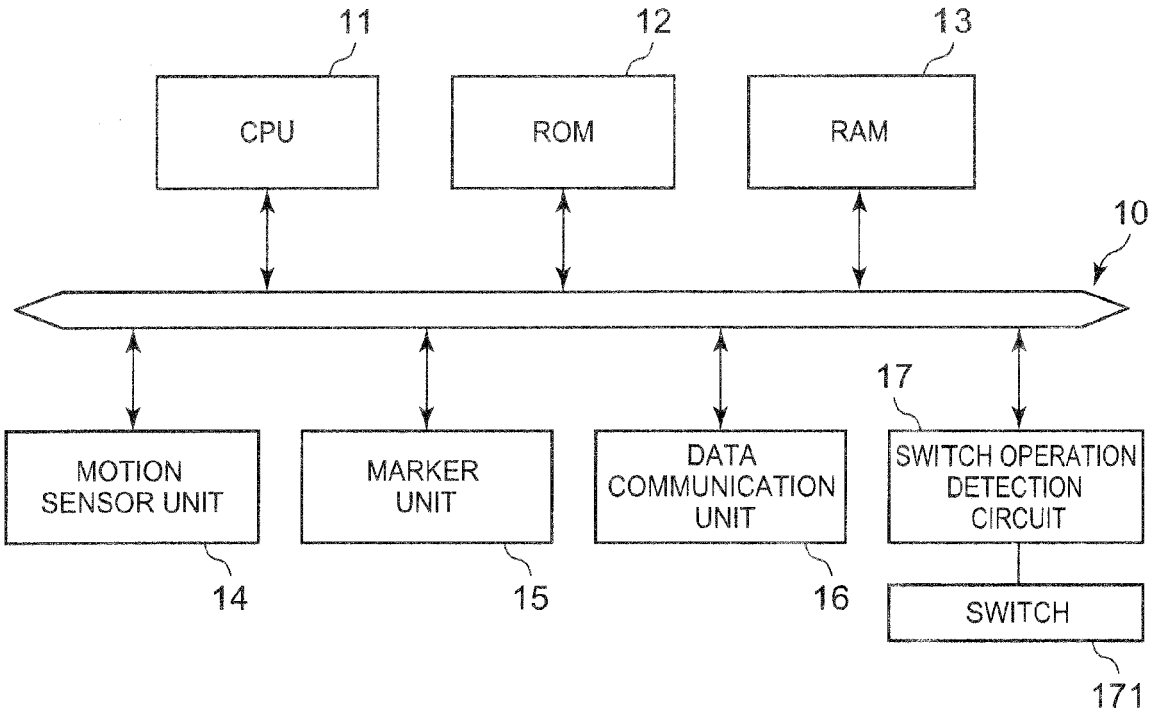
FIG. 2 is a block diagram showing a hardware configuration of a stick configuring the musical instrument.

FIG. 2 is a block diagram showing the hardware configuration of the stick 10. As shown in FIG. 2, the stick 10 is configured to include a CPU 11 (Central Processing Unit), ROM 12 (Read Only Memory), RAM 13 (Random Access Memory), a motion sensor unit 14, the marker 15, a data communication unit 16, and a switch operation detection circuit 17.

The CPU 11 executes control of the overall stick 10, and in addition to detection of the attitude of the stick 10, shot detection and action detection based on the sensor values outputted from the motion sensor unit 14, for example, also executes control such as light-emission and switch-off of the marker 15. At this time, the CPU 11 reads marker characteristic information from the ROM 12, and executes light-emission control of the marker 15 in accordance with this marker characteristic information. In addition, the CPU 11 executes communication control with the center unit 30 via the data communication unit 16.

The ROM 12 stores processing programs for various processing to be executed by the CPU 11. In addition, the ROM 12 stores the marker characteristic information used in the light-emission control of the marker 15. Herein, the camera unit 20 must distinguish between the marker 15 of the stick 10R (hereinafter referred to as "first marker" as appropriate) and the marker 15 of the stick 10L (hereinafter referred to as "second marker" as appropriate). Marker characteristic information is information for the camera unit 20 to distinguish between the first marker and the second marker, and in addition to the shape, size, color, chroma, or brightness during light emission, for example, it is possible to use the blinking speed or the like during light emission.

The CPU 11 of the stick 10R and the CPU 11 of the stick 10L read respectively different marker characteristic information, and execute light-emission control of the respective markers.

The RAM 13 stores the values acquired or generated in processing such as various sensor values outputted by the motion sensor unit 14.

The motion sensor unit 14 is various sensors for detecting the state of the stick 10, and outputs predetermined sensor values. Herein, an acceleration sensor, angular velocity sensor, magnetic sensor, or the like can be used as the sensors configuring the motion sensor unit 14, for example.

Figure 3:
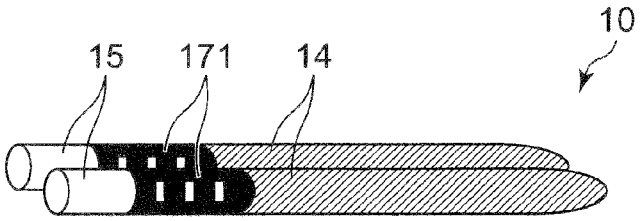
FIG. 3 is a perspective view of the stick.

FIG. 3 is a perspective view of the stick 10, in which a switch part 171 and the marker 15 are arranged on the outside.

The player holds one end (base side) of the stick 10, and carries out a swing up and swing down movement about the wrist or the like, thereby giving rise to motion of the stick 10. On this occasion, sensor values according to this motion come to be outputted from the motion sensor unit 14.

The CPU 11 having received the sensor values from the motion sensor unit 14 detects the state of the stick 10 being held by the player. As one example, the CPU 11 detects the striking timing of a virtual instrument by the stick 10 (hereinafter referred to as "shot timing"). The shot timing is the timing immediately prior to the stick 10 being stopped after being swung downward, and is the timing at which the magnitude of the acceleration in an opposite direction to the down swing direction acting on the stick 10 exceeds a certain threshold.

Referring back to FIG. 2, the marker 15 is a luminous body provided on a leading end side of the stick 10, is configured with an LED or the like, for example, and emits light and switches off depending on the control of the CPU 11. More specifically, the marker 15 emits light based on the marker characteristic information read by the CPU 11 from the ROM 12. At this time, since the marker characteristic information of the stick 10R and the marker characteristic information of the stick 10L differ, the camera unit 20 can distinctly acquire the position coordinates of the marker of the stick 10R (first marker) and the position coordinates of the marker of the stick 10L (second marker) separately.

The data communication unit 16 performs predetermined wireless communication with at least the center unit 30. The predetermined wireless communication may be configured to be performed by any method, and in the present embodiment, wireless communication with the center unit 30 is performed by way of infrared communication. It should be noted that the data communication unit 16 may be configured to perform wireless communication with the camera unit 20, and may be configured to perform wireless communication with the stick 10R and the stick 10L.

The switch operation detection circuit 17 is connected with a switch 171, and receives input information through this switch 171.

(Configuration of Camera Unit 20)

The explanation for the configuration of the stick 10 is as given above. Next, the configuration of the camera unit 20 will be explained while referencing FIG. 4.

Figure 4:
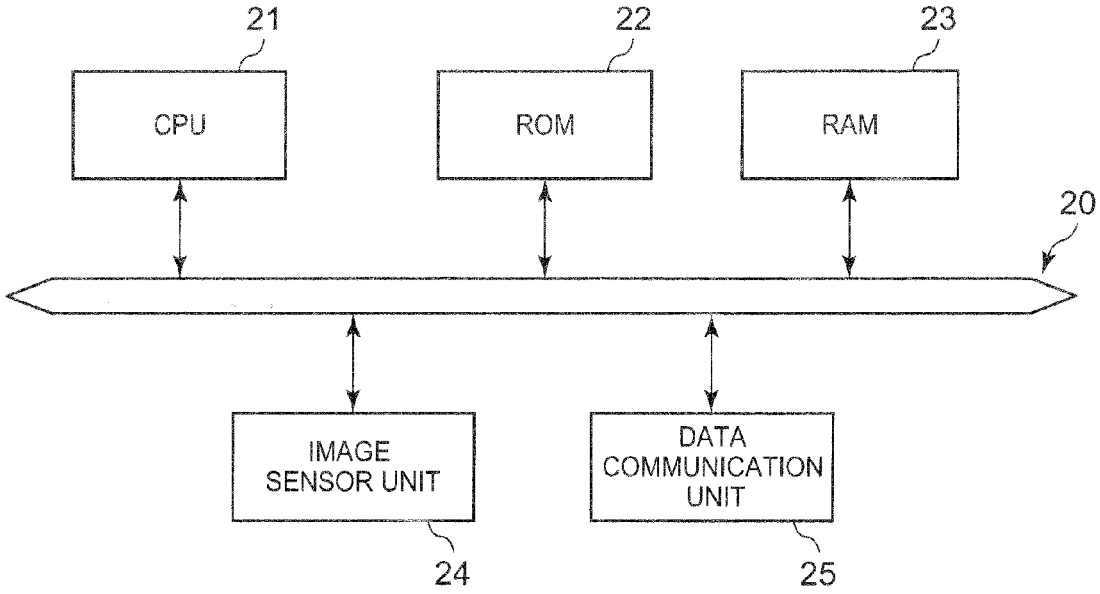
FIG. 4 is a block diagram showing a hardware configuration of a camera unit configuring the musical instrument.

FIG. 4 is a block diagram showing the hardware configuration of the camera unit 20.

The camera unit 20 is configured to include a CPU 21, ROM 22, RAM 23, an image sensor unit 24, and data communication unit 25.

The CPU 21 executes control of the overall camera unit 20 and, for example, based on the position coordinate data of the marker 15 detected by the image sensor unit 24 and marker characteristic information, executes control to calculate the position coordinate data of each of the markers 15 (first marker and second marker) of the sticks 10R and 10L, and output the position coordinate data indicating the calculation result of each. In addition, the CPU 21 executes communication control to transmit the calculated position coordinate data and the like to the center unit 30 via the data communication unit 25.

The ROM 22 stores processing programs for various processing executed by the CPU 21. The RAM 23 stores values acquired or generated in the processing such as position coordinate data of the marker 15 detected by the image sensor unit 24. In addition, the RAM 23 jointly stores the marker characteristic information of each of the sticks 10R and 10L received from the center unit 30.

The image sensor unit 24 is an optical camera, for example, and captures images of the player carrying out music playing movements while holding the sticks 10 at a predetermined frame rate. In addition, the image sensor unit 24 outputs image capture data of each frame to the CPU 21. It should be noted that, specifying of the position coordinates of the marker 15 of the stick 10 within a captured image may be performed by the image sensor unit 24, or may be performed by the CPU 21. Similarly, the marker characteristic information of the captured marker 15 also may be specified by the image sensor unit 24, or may be specified by the CPU 21.

The data communication unit 25 performs predetermined wireless communication (e.g., infrared communication) with at least the center unit 30. It should be noted that the data communication unit 25 may be configured to perform wireless communication with the sticks 10.

Configuration of Center Unit 30

The explanation for the configuration of the camera unit 20 is as given above. Next, the configuration of the center unit 30 will be explained while referencing FIG. 5.

Figure 5:
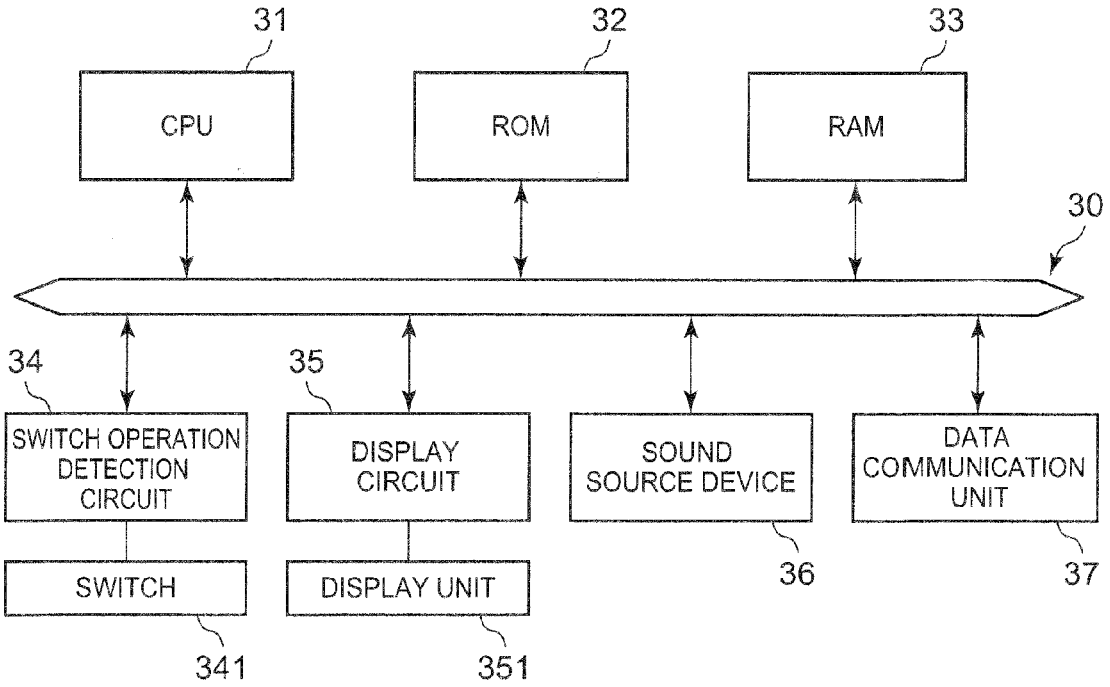
FIG. 5 is a block diagram showing a hardware configuration of a center unit configuring the musical instrument.

FIG. 5 is a block diagram showing the hardware configuration of the center unit 30.

The center unit 30 is configured to include a CPU 31, ROM 32, RAM 33, a switch operation detection circuit 34, a display circuit 35, a sound generating device 36, and a data communication unit 37.

The CPU 31 executes control of the overall center unit 30 and, for example, based on the shot detection received from the stick 10 and the position coordinates of the marker 15 received from the camera unit 20, executes control such as to generate predetermined musical notes. In addition, the CPU 31 executes communication control with the sticks 10 and the camera unit 20 via the data communication unit 37.

The ROM 32 stores processing programs of various processing executed by the CPU 31. In addition, to be associated with the position coordinates and the like, the ROM 32 stores the waveform data (tone data) of wind instruments such as the flute, saxophone and trumpet, keyboard instruments such as the piano, stringed instruments such as the guitar, and percussion instruments such as the bass drum, hi-hat, snare, cymbal and tam tam.

Figure 6:
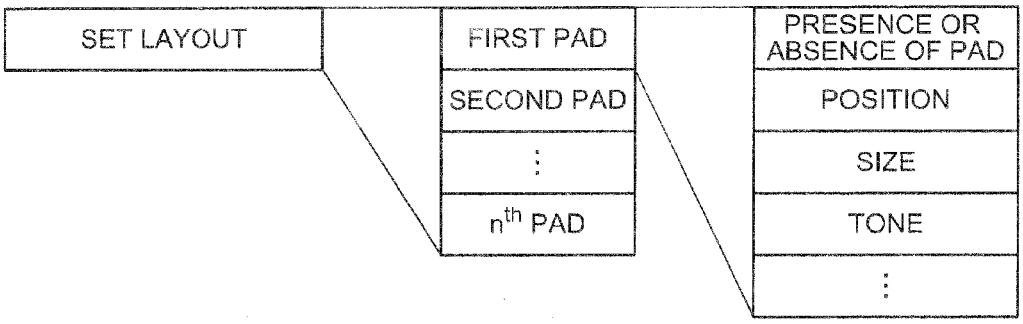
FIG. 6 is a diagram showing set layout information according to an embodiment of the musical instrument according to the present invention.

As the storage method of tone data and the like, for example, the set layout information includes n number of pad information from a first pad until an $n^{th}$ pad, and further, the presence of a pad (presence of a virtual pad existing on a virtual plane described later), position (position coordinates on virtual plane described later), size (shape, diameter, etc. of virtual pad), tone (waveform data), etc. are stored to be associated in respective pad information, as shown as set layout information in FIG. 6.

Figure 7:
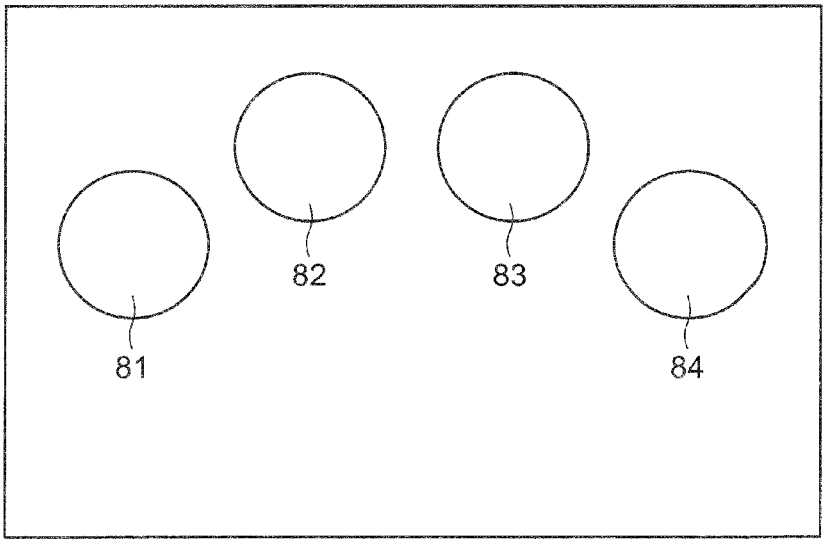
FIG. 7 is an illustration visualizing the concept indicated by the set layout information on a virtual plane.

Herein, the specific set layout will be explained while referencing FIG. 7. FIG. 7 is an illustration visualizing the concept indicated by the set layout information (refer to FIG. 6) stored in the ROM 32 of the center unit 30 on a virtual plane.

FIG. 7 shows an aspect of the four virtual pads 81, 82, 83 and 84 being arranged on a virtual plane, and among the first pad to $n^{th}$ pad, pads for which the pad presence data is "pad present" correspond to virtual pads 81, 82, 83 and 84. For example, the four of the second pad, third pad, fifth pad and sixth pad are corresponding. Furthermore, the virtual pads 81, 82, 83 and 84 are arranged based on position data and size data. Furthermore, tone data is also associated with each virtual pad. Therefore, in a case of the position coordinates of the marker 15 during shot detection belonging to a region corresponding to the virtual pad 81, 82, 83 or 84, a tone corresponding to the virtual pad 81, 82, 83 or 84 is generated. It should be noted that the CPU 31 may display this virtual plane on a display device 351 described later, along with the virtual pad 81 arrangement. In addition, in the present embodiment, the position coordinates on this virtual plane are established so as to match the position coordinates in the captured image of the camera unit 20.

Referring back to FIG. 5, the RAM 33 stores values acquired or generated in processing such as the state of the stick 10 received from the stick 10 (shot detection, etc.), the position coordinates of the marker 15 received from the camera unit 20, and set layout information read from the ROM 32.

By the CPU 31 reading tone data (waveform data) corresponding to the virtual pad 81 of the region to which the position coordinates of the marker 15 belong upon shot detection (i.e. upon Note-on-Event reception) from the set layout information stored in the RAM 33, a musical note in accordance with the music playing movement of the player is generated.

The switch operation detection circuit 34 is connected with a switch 341, and receives input information through this switch 341. The input information includes a change in the volume of a musical note generated or tone of a musical note generated, a setting and change in the set layout number, a switch in the display of the display device 351, and the like, for example.

In addition, the display circuit 35 is connected with a display device 351, and executes display control of the display device 351.

In accordance with an instruction from the CPU 31, the sound generating device 36 reads waveform data from the ROM 32, generates musical note data and converts the musical note data into an analog signal, and then generates musical notes from a speaker, which is not illustrated.

In addition, the data communication unit 37 performs predetermined wireless communication (e.g., infrared communication) with the sticks 10 and the camera unit 20.

(Processing of Musical Instrument 1)

The configurations of the sticks 10, camera unit 20 and center unit 30 configuring the musical instrument 1 have been explained in the foregoing. Next, processing of the musical instrument 1 will be explained while referencing FIGS. 8 to 11.

(Processing of Sticks 10)

Figure 8:
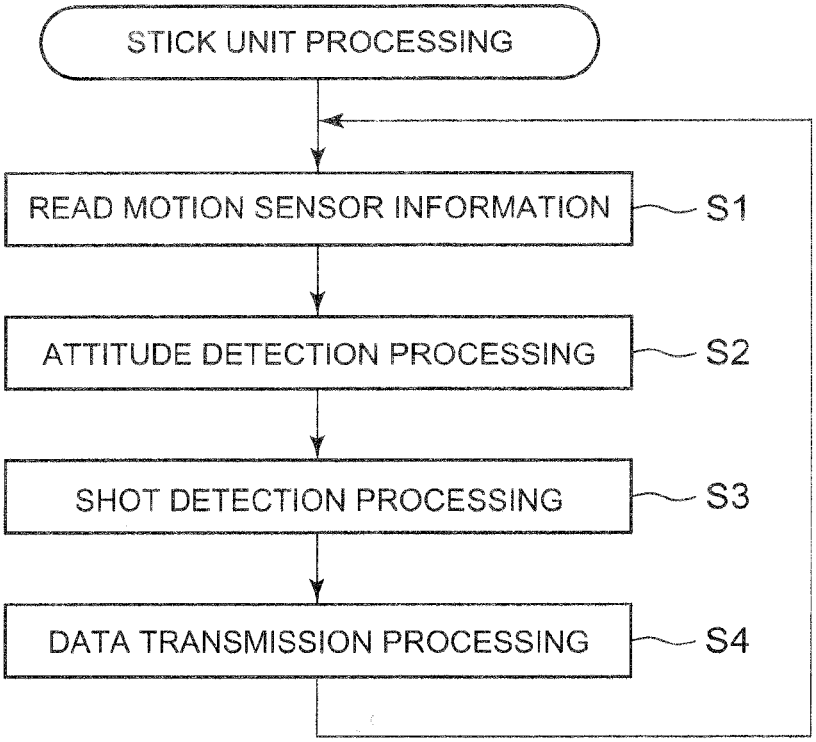
FIG. 8 is a flowchart showing the flow of processing of the stick.

FIG. 8 is a flowchart showing the flow of processing executed by the stick 10 (hereinafter referred to as "stick processing").

Referring to FIG. 8, the CPU 11 of the stick 10 reads motion sensor information from the motion sensor unit 14, i.e. sensor values outputted by various sensors, and stores the information in the RAM 13 (Step S1). Subsequently, the CPU 11 executes attitude sensing processing of the stick 10 based on the motion sensor information thus read (Step S2). In the attitude sensing processing, the CPU 11 detects the attitude of the stick 10, e.g., roll angle and pitch angle of the stick 10, based on the motion sensor information.

Next, the CPU 11 executes shot detection processing based on the motion sensor information (Step S3). Herein, in a case of a player carrying out music playing using the sticks 10, generally, similar music playing movements as the movements to strike an actual instrument (e.g., drums) are performed. With such music playing movements, the player first swings up the stick 10, and then swings down towards a virtual instrument. Then, just before striking the stick 10 against the virtual instrument, the player applies a force trying to stop the movement of the stick 10. At this time, the player assumes that a musical note will generate at the moment striking the stick 10 against the virtual instrument; therefore, it is desirable to be able to generate a musical note at the timing assumed by the player. Therefore, in the present embodiment, it is configured so as to generate a musical note at the timing of a moment the player strikes the stick 10 against the surface of a virtual instrument, or a short time before then.

In the present embodiment, the timing of shot detection is the timing immediately prior to the stick 10 being stopped after being swung downward, and is the timing at which the magnitude of the acceleration in an opposite direction to the down swing direction acting on the stick 10 exceeds a certain threshold.

With this timing of shot detection as the sound generation timing, when it is determined that the sound generation timing has arrived, the CPU 11 of the stick 10 generates a Note-on-Event, and sends the Note-on-Event to the center unit 30. The sound generation processing is thereby executed in the center unit 30 and a musical note is generated.

In the shot detection processing indicated in Step S3, a Note-on-Event is generated based on motion sensor information (e.g., a sensor composite value of the acceleration sensor). At this time, it may be configured so as to include the volume of the generating musical note in the generated Note-on-Event. It should be noted that the volume of a musical note can be obtained from the maximum value of a sensor composite value, for example.

Next, the CPU 11 transmits information detected in the processing of Steps S1 to S3, i.e. motion sensor information, attitude information and shot information, to the center unit 30 via the data communication unit 16 (Step S4). At this time, the CPU 11 transmits the motion sensor information, attitude information and shot information to the center unit 30 to be associated with the stick identifying information.

The processing is thereby returned to Step S1, and this and following processing is repeated.

(Processing of Camera Unit 20)

Figure 9:
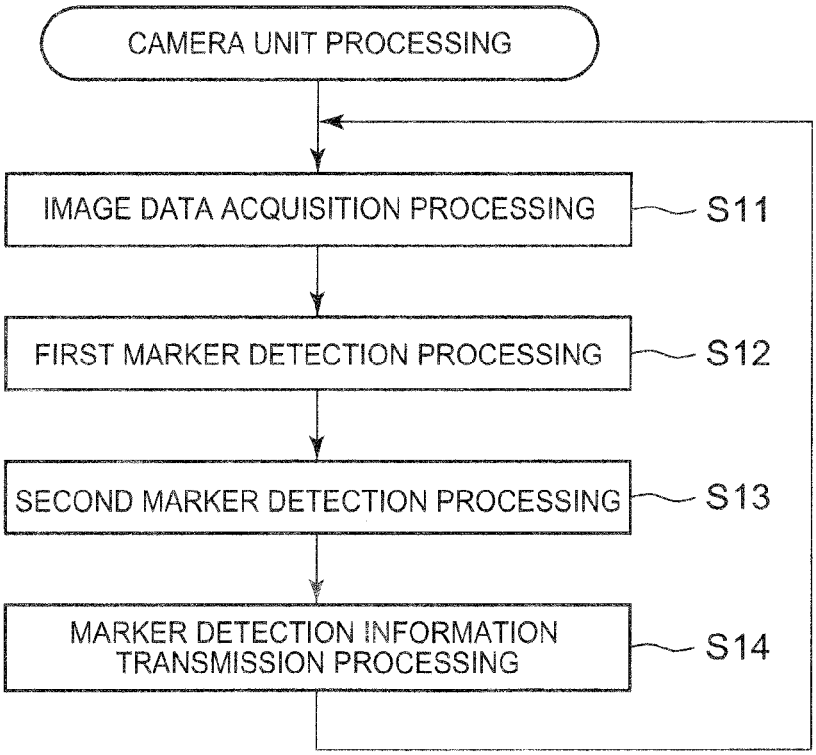
FIG. 9 is a flowchart showing the flow of processing of the camera unit.

FIG. 9 is a flowchart showing the flow of processing executed by the camera unit 20 (hereinafter referred to as "camera unit processing").

Referring to FIG. 9, the CPU 21 of the camera unit 20 executes image data acquisition processing (Step S11). In this processing, the CPU 21 acquires image data from the image sensor unit 24.

Next, the CPU 21 executes first marker detection processing (Step S12) and second marker detection processing (Step S13). In the respective processing, the CPU 21 acquires, and stores in the RAM 23, marker detection information such as of the position coordinates, size and angle of the marker 15 (first marker) of the stick 10R and the marker 15 (second marker) of the stick 10L, detected by the image sensor unit 24. At this time, the image sensor unit 24 detects marker detection information for the markers 15 emitting light.

Next, the CPU 21 transmits the marker detection information acquired in Step S12 and Step S13 to the center unit 30 via the data communication unit 25 (Step S14), and then advances the processing to Step S11.

(Processing of Center Unit 30)

Figure 10:
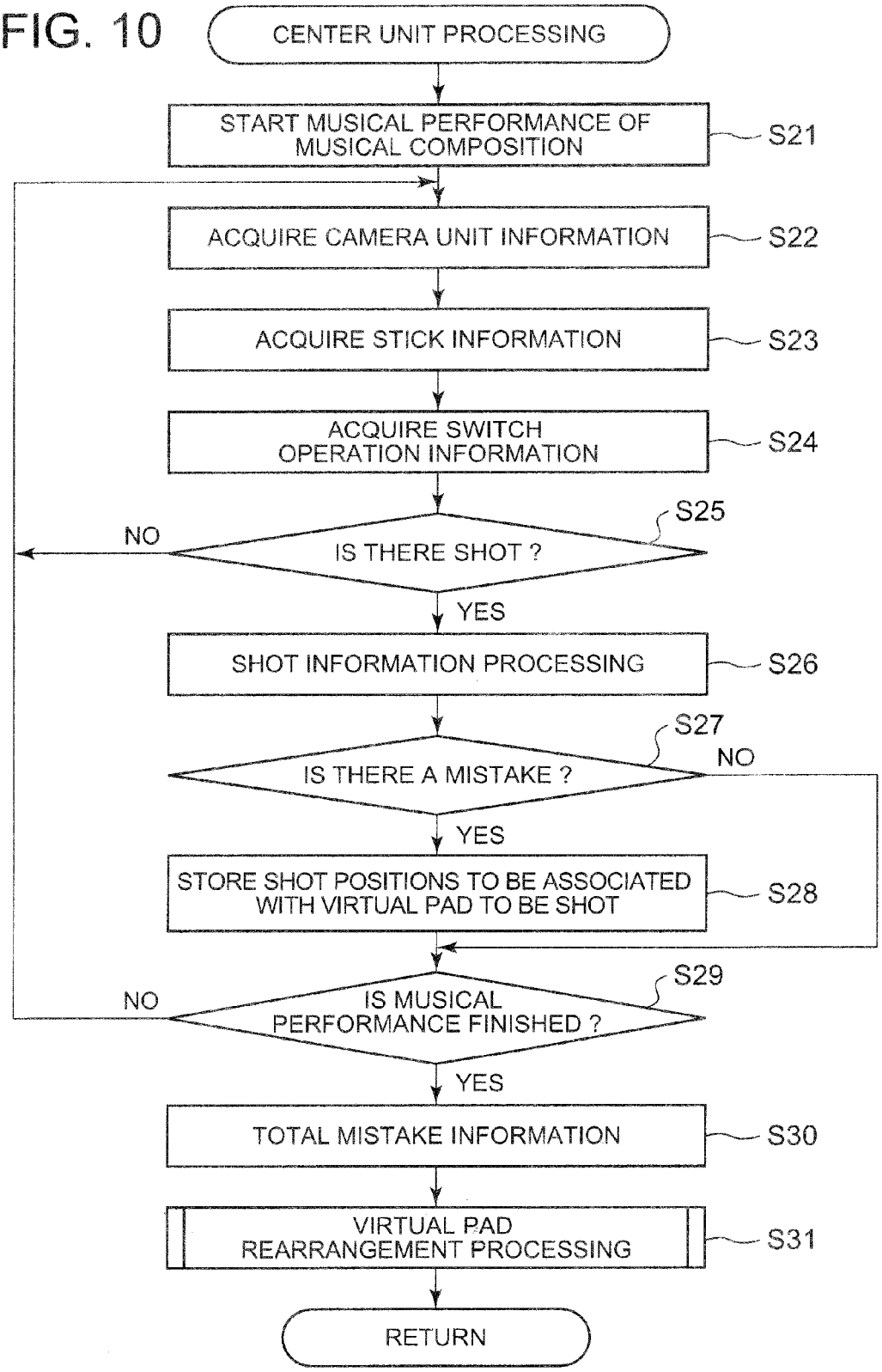
FIG. 10 is a flowchart showing the flow of processing of the center unit.

FIG. 10 is a flowchart showing the flow of processing executed by the center unit 30 (hereinafter referred to as "center unit processing").

Referring to FIG. 10, the CPU 31 of the center unit 30 starts the musical performance of a musical composition (Step S21). In this processing, the CPU 31 plays back the musical composition without generating drum sounds. The data of this musical composition is MIDI (Musical Instrument Digital Interface) data, and at every timing that is fixed according to the tempo, musical note, rest, etc. of the musical composition, the virtual pads 81, 82, 83 and 84 to be shot by the player are associated. On this occasion, the CPU 31 may display the sheet music of the drum pad on the display device 351 via the display circuit 35. It should be noted that a plurality of types of musical composition data exist, and each is stored in the ROM 32. The CPU 31 reads musical composition data from the ROM 32, and stores in the RAM 33 to perform playback processing. The musical composition data read by the CPU 31 may be determined randomly, or may be determined based on the operation of switches 341 by the player.

Next, the CPU 31 receives the respective marker detection information of the first marker and the second marker from the camera unit 20, and stores the information in the RAM 33 (Step S22). In addition, the CPU 31 receives motion sensor information, attitude information and shot information associated with stick identifying information from each of the sticks 10R and 10L, and stores the information in the RAM 33 (Step S23). Furthermore, the CPU 31 acquires information inputted by way of the operation of the switches 341 (Step S24).

Next, the CPU 31 determines whether or not there is a shot (Step S25). In this processing, the CPU 31 determines the presence of a shot according to whether or not a Note-on-Event has been received from the sticks 10. At this time, in a case of having determined there is a shot, the CPU 31 executes shot information processing (Step S26). In a case of having determined there is not a shot, the CPU 31 causes the processing to advance to Step S22.

In the shot information processing, the CPU 31 reads, from the set layout information read into the RAM 33, tone data (waveform data) corresponding to any of the virtual pads 81, 82, 83 and 84 of the region to which the position coordinates included in the marker detection information belong, and outputs to the sound generating device 36 along with the volume data included in the Note-on-Event. Then, the sound generating device 36 generates a corresponding musical note based on the accepted waveform data.

Next, the CPU 31 determines whether there has been a shot (Step S27). More specifically, the CPU 31 determines there has been a mistake in a case of the position coordinates included in the marker detection information of Step S26 not belonging to a region of the virtual pad to be shot.

In a case of having determined that there was a mistake in Step S27, the CPU 31 stores the shot position to be associated with the virtual pad to be shot (Step S28). More specifically, the CPU 31 stores the position coordinates included in the marker detection information of Step S26 in the RAM 33 to be associated with the virtual pad to be shot.

In the case of having determined that there is not a mistake in Step S27, or when the processing of Step S28 ends, the CPU 31 determines whether the musical performance of the musical composition has ended (Step S29). More specifically, the CPU 31 determines whether the musical composition played back in Step S21 has been played to the end, or whether the playback of the musical composition has been forcibly ended by way of the switch 341 being operated. If it is determined that the musical performance of the musical composition is not finished, the CPU 31 causes the processing to advance to Step S22.

If it is determined that the music playing of the musical composition has finished, the CPU 31 totals the mistake information (Step S30). For example, the CPU 31 creates the coordinate distribution of positions of mistake shots stored in the RAM 33 in Step S28 to be associated with each of the virtual pads 81, 82, 83 and 84. An aspect of the coordinate distribution of positions of the mistake shots is shown in the top illustration in FIG. 12. According to this illustration, the position coordinates of the mistake shots at the periphery of the virtual pads 81 and 83 are distributed, and the position coordinates of the mistake shots are distributed in specific directions for the virtual pads 82 and 84, respectively.

Figure 11:
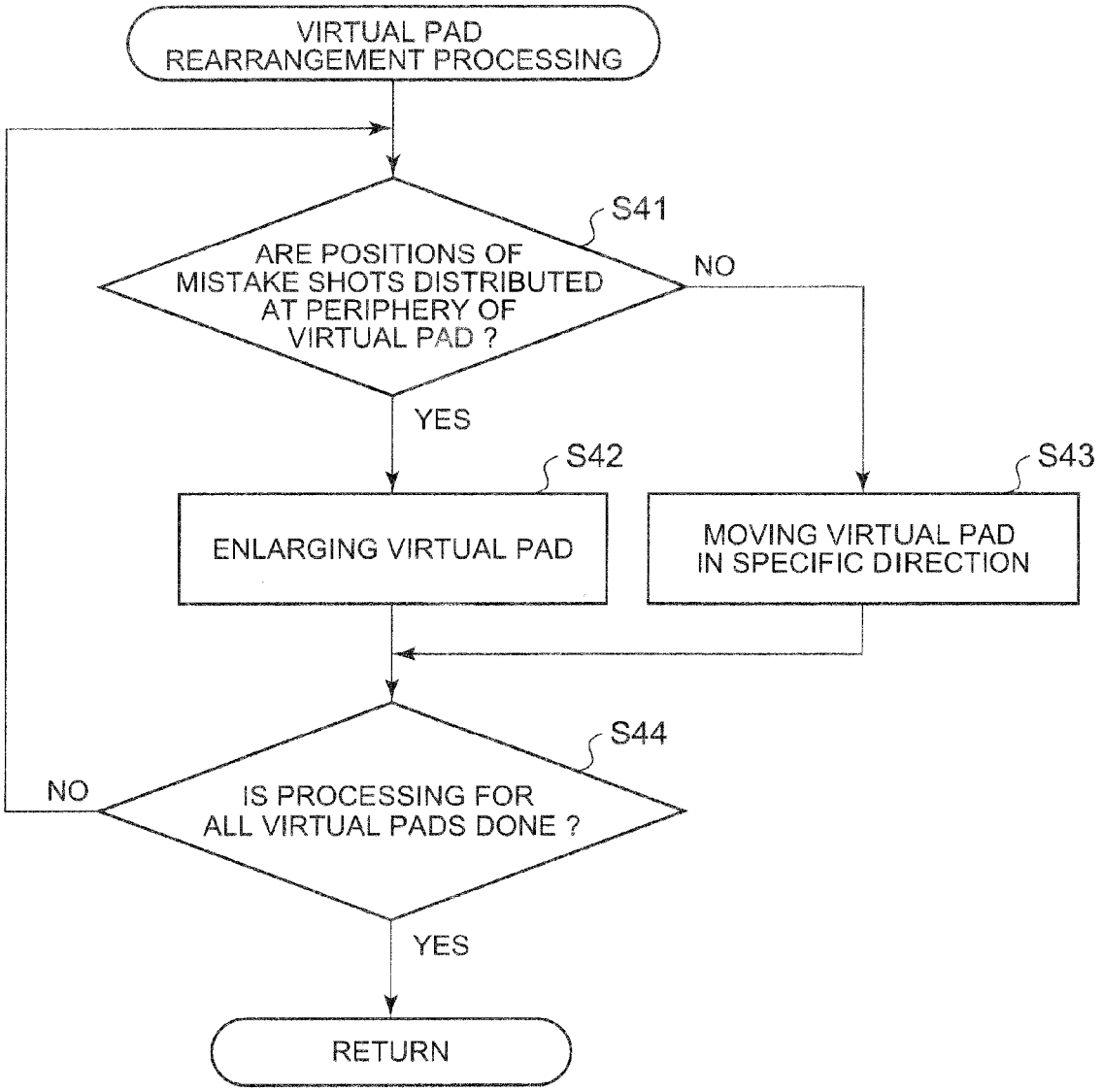
FIG. 11 is a flowchart showing the flow of virtual pad rearrangement processing of the center unit.

When the processing of Step S30 ends, the CPU 31 executes virtual pad rearrangement processing explained referring to FIG. 11 (Step S31), and ends the center unit processing.

(Virtual Pad Rearrangement Processing of Center Unit 30)

FIG. 11 is a flowchart showing the detailed flow of virtual pad rearrangement processing of Step S31, among the center unit processing shown in FIG. 10.

Referring to FIG. 11, the CPU 31 determines whether the position coordinates of the mistake shots are distributed at the periphery of the virtual pad (Step S41). More specifically, the determination is performed based on the coordinate distribution of positions of mistake shots created in Step S30 of FIG. 10.

In Step S41, in a case of having determined that the position coordinates of mistake shots are distributed at the periphery of a virtual pad, the CPU 31 enlarges the virtual pad (Step S42), and in a case of not having determined that the position coordinates of mistake shots are distributed at the periphery of a virtual pad, the CPU 31 causes the virtual pad to move in a specific direction (Step S43).

Figure 12:
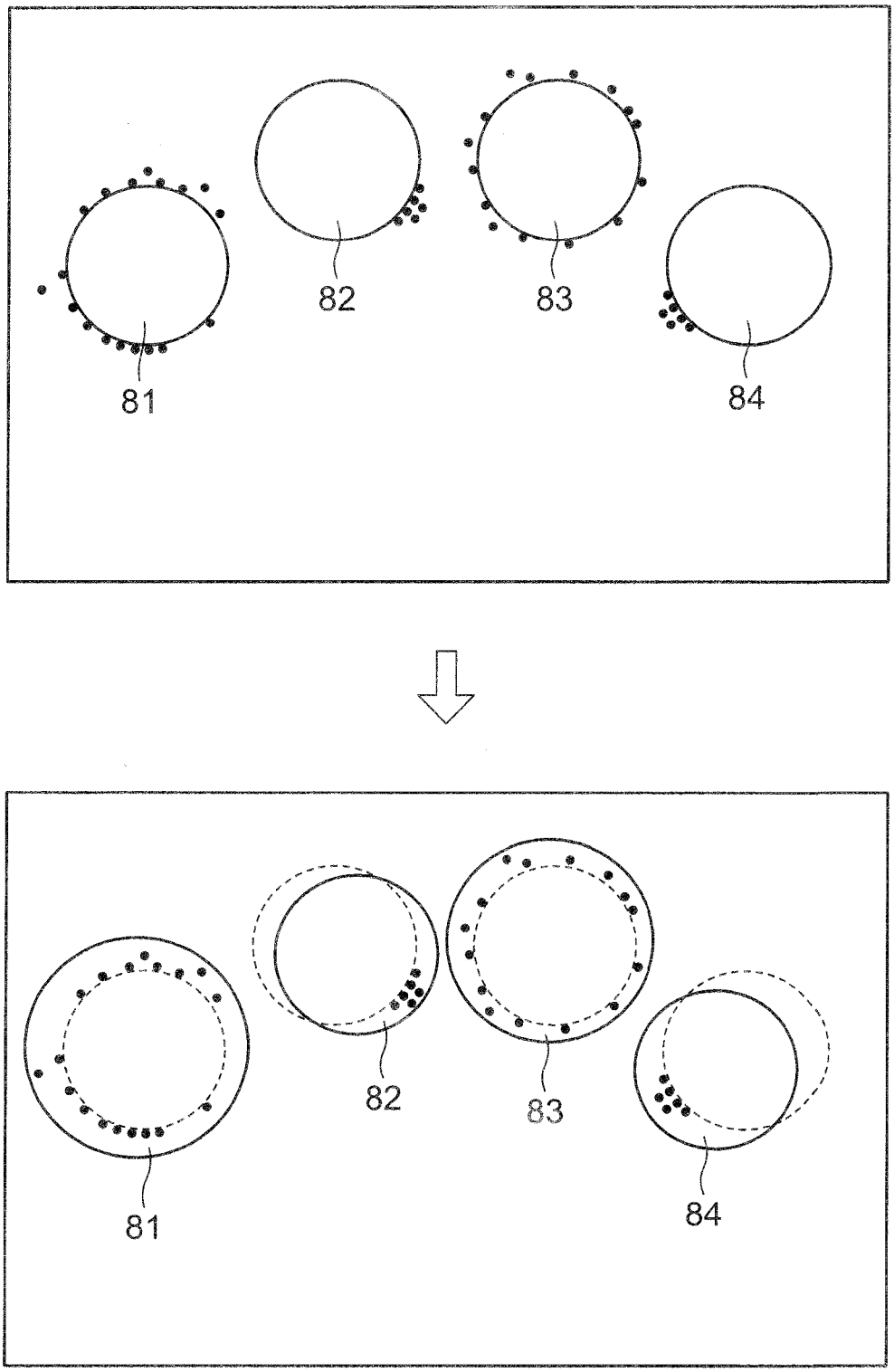
FIG. 12 is an illustration showing an example of rearrangement of virtual pads.

In a case of enlarging a virtual pad, since the position coordinates of mistake shots are distributed at the periphery for the virtual pads 81 and 83, as shown in FIG. 12, the CPU 31 rearranges the virtual pads by causing the virtual pads 81 and 83 to be enlarged so as to include the position coordinates of the mistake shots.

In a case of causing a virtual pad to move in a specific direction, since the position coordinates of mistake shots are distributed in a specific direction for the virtual pads 82 and 84, respectively, as shown in FIG. 12, the CPU 31 rearranges the virtual pads by causing the virtual pads to each move in a specific direction so as to include the position coordinates of the mistake shots.

When the processing of Step S42 or Step S43 ends, the CPU 31 determines whether the processing for all of the virtual pads (virtual pads 81, 82, 83 and 84) has been done (Step S44). In a case of having determined that the processing for all of the virtual pads has been done, the CPU 31 ends the virtual pad rearrangement processing, and in a case of having determined that the processing for all of the virtual pads has not been done, causes the processing to advance to Step S41.

The configuration and processing of the musical instrument 1 of the present embodiment has been explained in the foregoing.

In the present embodiment, among the virtual pads 81, 82, 83 and 84, the CPU 31 designates a virtual pad of a region to which the position coordinates of the stick 10 should belong at the timing at which a shot operation was made by the stick 10 based on musical composition data, and in a case of the position coordinates of the stick 10 not belonging to the region of the designated virtual pad at the timing at which the shot operation was made by way of the stick 10, associates these position coordinates with a designated virtual pad, and rearranges the region of the designated virtual pad so as to include the associated position coordinates.

Accordingly, the arrangement of the virtual pads 81, 82, 83 and 84 arranged based on the layout information can be rearranged so as to include the position coordinates of shots in a case of the player having made striking mistakes.

Therefore, it is possible to provide a musical instrument enabling enjoyment of music playing, even for a player liable to make shot mistakes such as a beginner to drum playing.

In addition, in the present embodiment, the CPU 31 determines the method of rearrangement of the designated regions, depending on the distribution condition of position coordinates upon mistake shots associated with the virtual pad designated so as to be shot.

Accordingly, it is possible to prevent the region of a virtual pad from being enlarged more than necessary. In addition, the region of a virtual pad can be rearranged to a required position.

Although embodiments of the present invention have been explained above, the embodiments are merely exemplifications, and are not to limit the technical scope of the present invention. The present invention can adopt various other embodiments, and further, various modifications such as omissions and substitutions can be made thereto within a scope that does not deviate from the gist of the present invention. These embodiments and modifications thereof are included in the scope and gist of the invention described in the present disclosure, and are included in the invention described in the accompanying claims and the scope of equivalents thereof.

In the above embodiment, a virtual drum set D (refer to FIG. 1B) has been explained as a virtual percussion instrument to give an example; however, it is not limited thereto, and the present invention can be applied to other instruments such as a xylophone, which generates musical notes by down swing movements of the sticks 10.

What is claimed is:

1. A musical instrument, comprising:

a position sensor that detects position coordinates on a virtual plane of a music playing member that can be held by a player;

a determination unit that determines whether the position coordinates of the music playing member are located within a region at a timing at which a specific music playing operation is made by way of the music playing member, wherein a position and a size of the region, which is arranged on the virtual plane, is defined by layout information;

a sound generation instruction unit that, when the position coordinates of the music playing member are determined to be located within the region, instructs sound generation of a musical note corresponding to the region;

a discrimination unit that, when the position coordinates of the music playing member are determined to be not located within the region, discriminates how the position coordinates of the music playing member determined to be not located within the region are distributed at a periphery of the region; and a modification unit that modifies one of the position and the size of the region, based on a discrimination result of the discrimination unit, wherein the modification unit modifies the position of the region when the position coordinates of the music playing member are distributed in a specific direction, and modifies the size of the region when the position coordinates of the music playing member are not distributed in a specific direction.

2. The musical instrument according to claim 1, wherein the position sensor is an image-capturing device that captures an image in which the virtual plane is a captured image plane and the music playing member is a subject, and that detects the position coordinates of the music playing member on the captured image plane.

3. The musical instrument according to claim 1, wherein:

a plurality of regions arranged on the virtual plane are defined by the layout information, the musical instrument further comprises a region designating unit that sequentially designates, from among the plurality of regions, a region in which the position coordinates of the music playing member should be located at each of a plurality of different timings at which a specific music playing operation is made by way of the music playing member, and the determination unit determines whether the position coordinates of the music playing member belong to any of the plurality of regions arranged based on the layout information.

4. The musical instrument according to claim 1, wherein the modification unit modifies the layout information in order to modify the region, when the position coordinates of the music playing member are determined to be not located within the region, based on the discrimination result of the discrimination unit.

5. A method for a musical instrument having a position sensor that detects position coordinates on a virtual plane of a music playing member that can be held by a player, the method comprising:

determining whether the position coordinates of the music playing member are located within a region at a timing at which a specific music playing operation is made by way of the music playing member, wherein a position and a size of the region, which is arranged on the virtual plane, is defined by layout information;

instructing, when the position coordinates of the music playing member are determined to be located within the region, generation of a sound of a musical note corresponding to the region;

discriminating, when the position coordinates of the music playing member are determined to be not located within the region, how the position coordinates of the music playing member determined to be not located within the region are distributed at a periphery of the region; and modifying one of the position and the size of the region based on a result of the discriminating, wherein the modifying modifies the position of the region when the position coordinates of the music playing member are distributed in a specific direction, and modifies the size of the region when the position coordinates of the music playing member are not distributed in a specific direction.

6. The method according to claim 5, wherein the position sensor is an image-capturing device that captures an image in which the virtual plane is a captured image plane and the music playing member is a subject, and that detects the position coordinates of the music playing member on the captured image plane.

7. The method according to claim 5, wherein a plurality of regions arranged on the virtual plane are defined by the layout information, and wherein the method further comprises:

sequentially designating, from among the plurality of regions, a region in which the position coordinates of the music playing member should be located at each of a plurality of different timings at which a specific music playing operation is made by way of the music playing member, and determining whether the position coordinates of the music playing member belong to any of the plurality of regions arranged based on the layout information.

8. The method according to claim 5, wherein the modifying modifies the layout information in order to modify the region, when the position coordinates of the music playing member are determined to be not located within the region, based on the result of the discriminating.

9. A non-transitory computer-readable recording medium used in a musical instrument having a position sensor that detects position coordinates on a virtual plane of a music playing member that can be held by a player, the recording medium being encoded with a program that enables a computer of the musical instrument to execute functions comprising:

determining whether the position coordinates of the music playing member are located within a region at a timing at which a specific music playing operation is made by way of the music playing member, wherein a position and a size of the region, which is arranged on the virtual plane, is defined by layout information;

instructing, when the position coordinates of the music playing member are determined to be located within the region, generation of a sound of a musical note corresponding to the region;

discriminating, when the position coordinates of the music playing member are determined to be not located within the region, how the position coordinates of the music playing member determined to be not located within the region are distributed at a periphery of the region; and modifying one of the position and the size of the region based on a result of the discriminating, wherein the modifying modifies the position of the region when the position coordinates of the music playing member are distributed in a specific direction, and modifies the size of the region when the position coordinates of the music playing member are not distributed in a specific direction.

10. The recording medium according to claim 9, wherein the position sensor is an image-capturing device that captures an image in which the virtual plane is a captured image plane and the music playing member is a subject, and that detects the position coordinates of the music playing member on the captured image plane.

11. The recording medium according to claim 9, wherein a plurality of regions arranged on the virtual plane are defined by the layout information, and wherein the program enables the computer of the musical instrument to execute further functions comprising:

sequentially designating, from among the plurality of regions, a region in which the position coordinates of the music playing member should be located at each of a plurality of different timings at which a specific music playing operation is made by way of the music playing member, and determining whether the position coordinates of the music playing member belong to any of the plurality of regions arranged based on the layout information.

12. The recording medium according to claim 9, wherein the modifying modifies the layout information in order to modify the region, when the position coordinates of the music playing member are determined to be not located within the region, based on the result of the discriminating.

* * * * *